US005725141A

United States Patent [19]

Chi

[11] Patent Number: 5,725,141

[45] Date of Patent: Mar. 10, 1998

[54] STRIKE-TYPE BINDING DEVICE

[76] Inventor: William H. N. Chi, 8F-2, No. 92, Chingcheng Rd., West Dist., Taichung, Taiwan

[21] Appl. No.: 694,943

[22] Filed: Aug. 9, 1996

[51] Int. Cl.[6] ..... B25C 5/16

[52] U.S. Cl. ..... 227/109; 227/147

[58] Field of Search ..... 227/109, 120, 227/147, 156, 134

[56] References Cited

U.S. PATENT DOCUMENTS

| | | | |
|---|---|---|---|
| 2,664,565 | 1/1954 | Percoco | 227/147 |
| 2,716,749 | 9/1955 | Timmerbeil | 227/147 |
| 3,958,738 | 5/1976 | Tremblay | 227/109 |
| 4,552,296 | 11/1985 | Sheng | 227/109 |
| 4,732,309 | 3/1988 | Judge | 227/109 |

*Primary Examiner*—Scott A. Smith

*Attorney, Agent, or Firm*—Holland & Hart LLP

[57] ABSTRACT

A strike-type binding device includes a handle portion fixedly mounted on a first end portion of a striking bracket. A staple magazine has a guiding channel defined therein for receiving staples and includes a first end portion pivotally engaged with the first end portion of the striking bracket and a second end portion having a chamber defined therein and communicating with the guiding channel. A staple positioning member is mounted in the chamber and includes a first side having a first receiving space defined therein and a second side having a second receiving space defined therein. The first and second receiving spaces have a dimension different from each other for receiving staples of different sizes therein.

3 Claims, 4 Drawing Sheets

STRIKE-TYPE BINDING DEVICE

FIELD OF THE INVENTION

The present invention relates to a binding device, and more particularly to a strike-type binding device.

BACKGROUND OF THE INVENTION

A conventional striking-type binding device comprises a striking bracket having a first end portion pivotally engaged with a staple magazine which has a guiding channel for receiving and guiding staples therein, and a second end portion having an urging flange detachably abutting on the staples. A handle portion is fixedly mounted on the first end portion of the striking bracket.

In operation, a user can thrust downward the handle portion such that the striking bracket together with the staple magazine is struck on a workpiece such as a sheet of paper, a piece of leather and the like, with the staples being urged by the urging flange to be ejected from an underside of the staple magazine into the workpiece and into an object such as a floor, a board and the like, thereby securely binding the workpiece on the object.

By such an arrangement, however, the guiding channel is suitable for staples of one size only such that the binding device cannot be adapted to operate staples of different sizes, thereby greatly limiting the versatility of the binding device.

The present invention has arisen to mitigate and/or obviate the disadvantage of the conventional binding device.

SUMMARY OF THE INVENTION

In accordance with one aspect of the present invention, there is provided a strike-type binding device comprising a striking bracket having a first end portion and a second end portion and a handle portion fixedly mounted on the first end portion of the striking bracket.

A staple magazine has a guiding channel longitudinally defined therein for receiving staples and includes a first end portion pivotally engaged with the first end portion of the striking bracket and a second end portion having a chamber defined therein and communicating with the guiding channel.

A staple positioning member is mounted in the chamber and includes a first side having a first receiving space defined therein and a second side having a second receiving space defined therein. The first and second receiving spaces have a dimension different from each other for receiving staples of different sizes therein.

Further features of the present invention will become apparent from a careful reading of the detailed description with reference to the accompanying drawings.

DETAILED DESCRIPTION OF THE PREFERRED EMBODIMENTS

Figure 1:
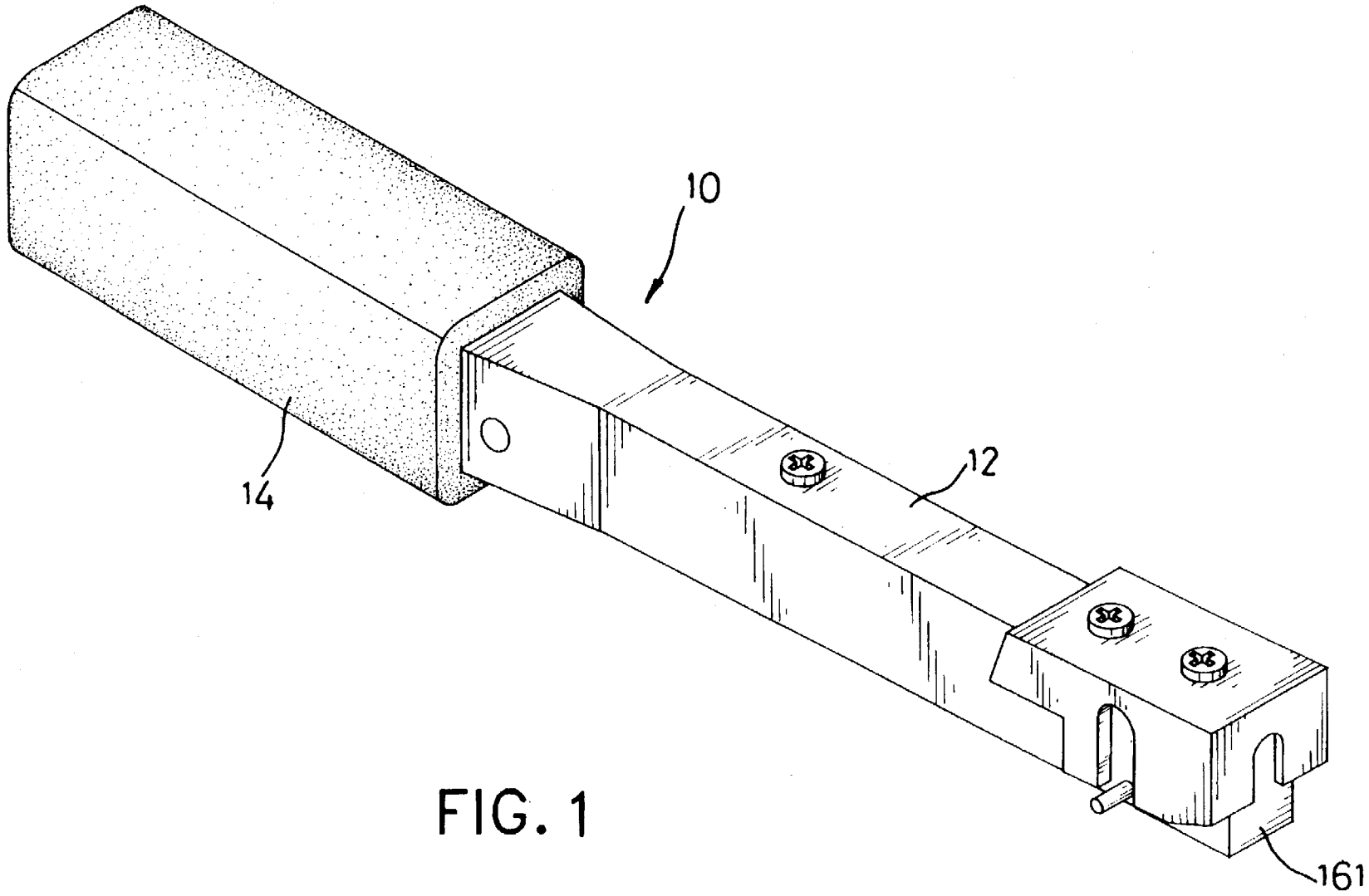
FIGS. 1 and 2 are perspective views of a binding device in accordance with the present invention.
Figure 2:
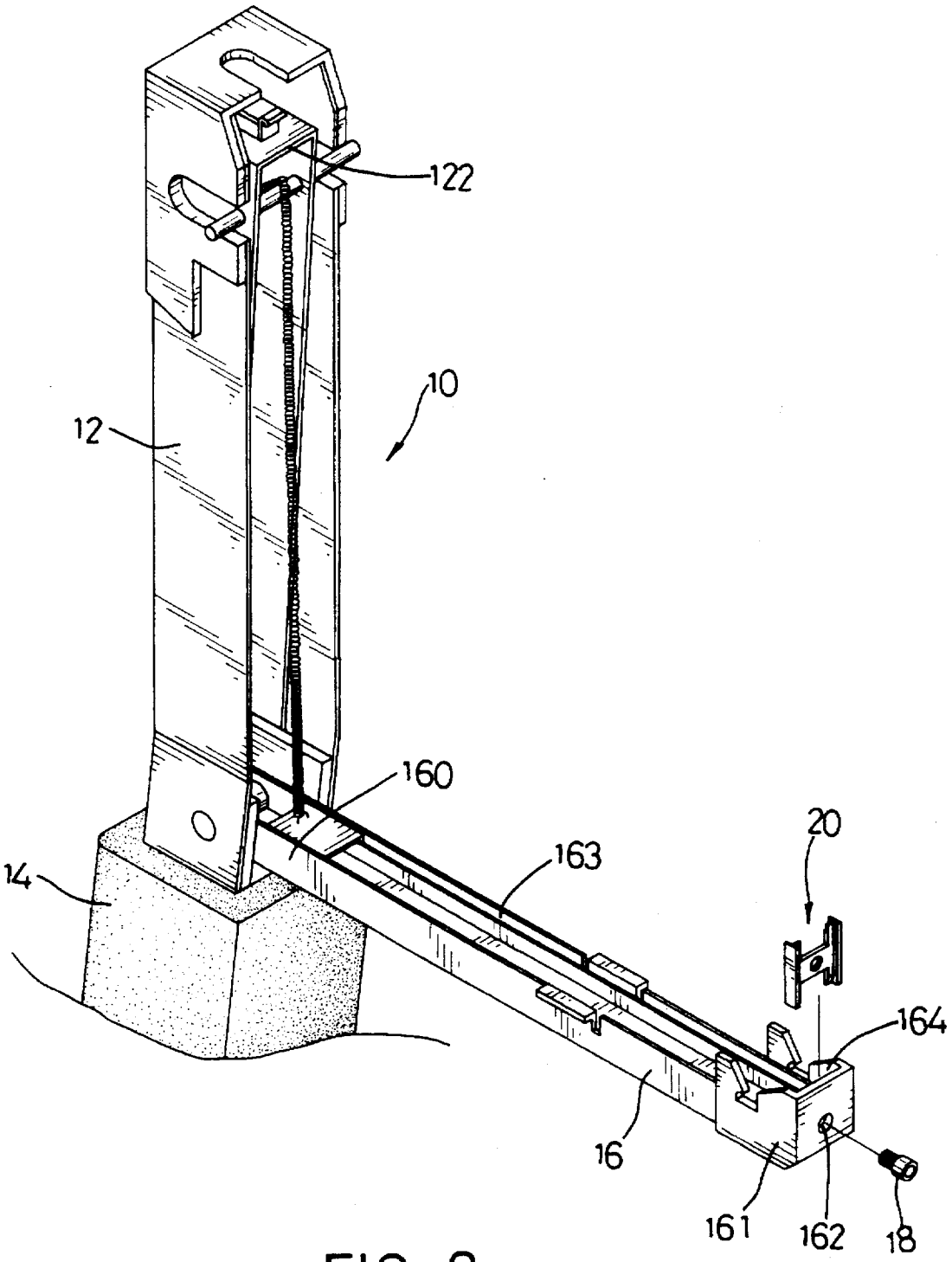
Figure 3:
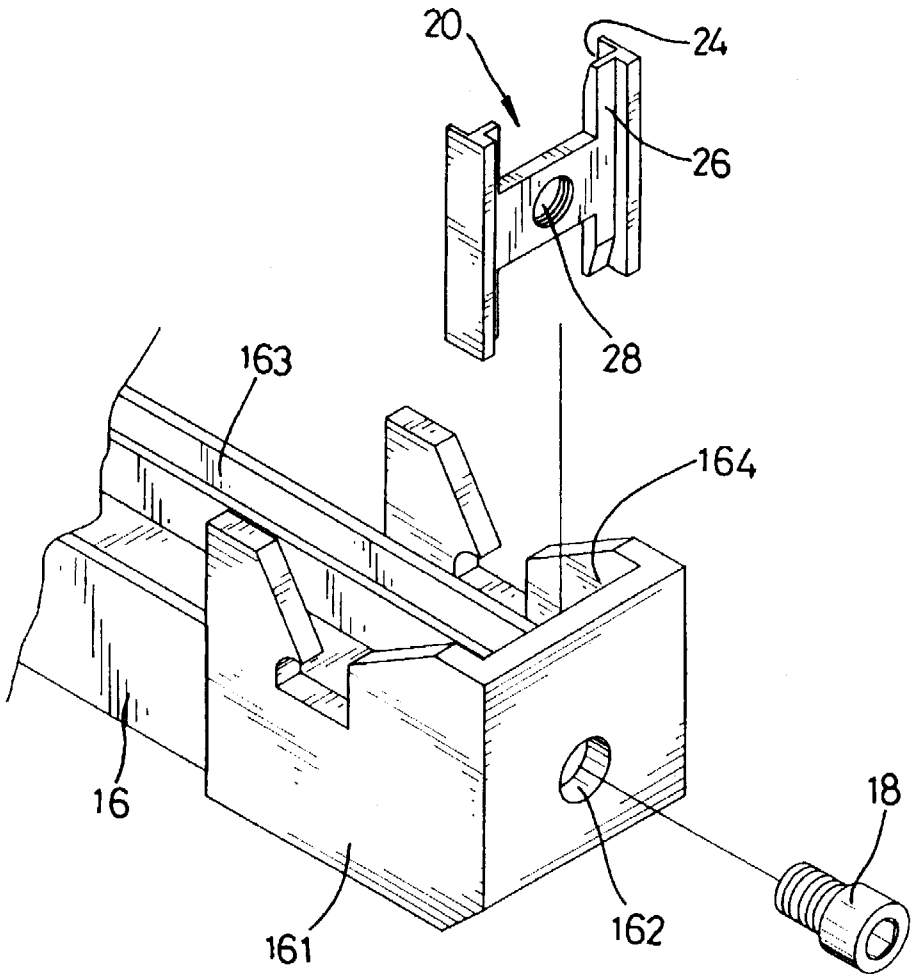
FIG. 3 is a partially enlarged view showing a staple magazine and a staple positioning member.

Referring to the drawings, and initially to FIGS. 1–3, a strike-type binding device 10 in accordance with the present invention comprises a striking bracket 12 having a first end portion and a second end portion, and a handle portion 14 fixedly mounted on the first end portion of the striking bracket 12.

A staple magazine 16 includes a guiding channel 163 longitudinally defined therein for receiving staples and includes a first end portion 160 pivotally engaged with the first end portion of the striking bracket 12 and a second end portion 161 having a chamber 164 defined therein and communicating with the guiding channel 163. Preferably, the second end portion 161 of the staple magazine 16 is formed with a supporting bracket configuration.

A staple positioning member 20 having an H-shaped cross-section is securely mounted in the chamber 164 and includes a first side having a first receiving space 24 defined therein and a second side having a second receiving space 26 defined therein. The first and second receiving spaces 24 and 26 have a dimension different from each other for receiving staples of different sizes. Preferably, the dimension of the first receiving space 24 is greater than that of the second receiving space 26.

The staple positioning member 20 has a hole 28 defined by a threaded wall thereof. A bore 162 is defined in a side wall of the second end portion 161 of the staple magazine 16 and aligns with the hole 28. A positioning bolt 18 extends through the bore 162 and is threadedly received in the hole 18, thereby securing the staple positioning member 20 in the chamber 164 of the second end portion 161 of the staple magazine 16.

In operation, referring to FIGS. 1 and 2 with reference to FIG. 3, the operation of the binding device 10 is similar to that of the stapler and the like.

Figure 5:
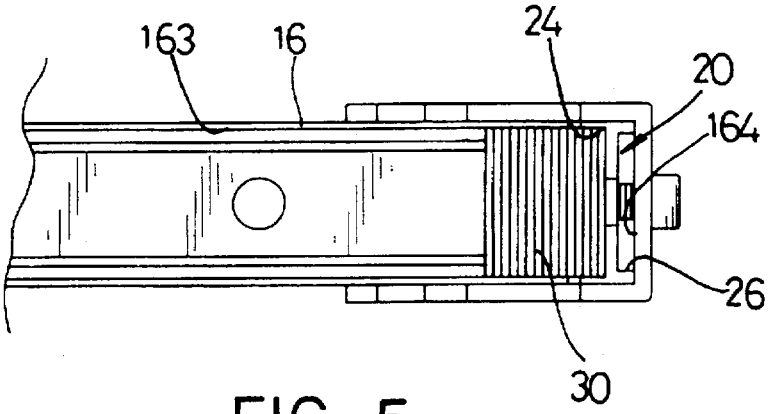
FIGS. 5 and 6 are top plan views of FIG. 3, showing the staple positioning member being disposed at two different locations.
Figure 6:
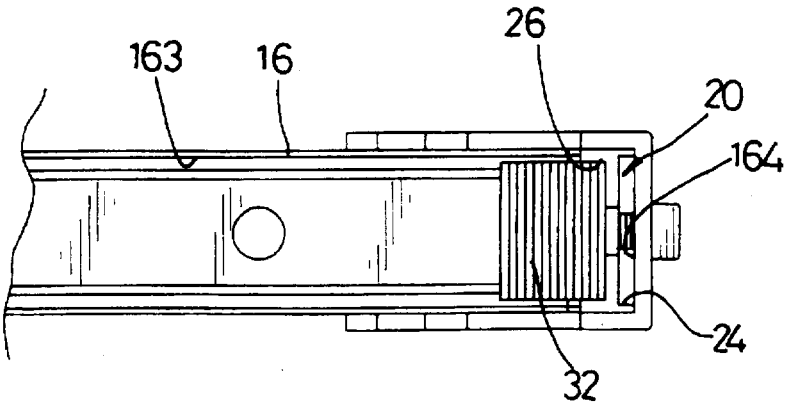

First of all, the staple positioning member 20 can be received in the chamber 164 of the staple magazine 16 for positioning therein a plurality of staples 30 (see FIG. 5) or 32 (see FIG. 6).

The striking bracket 12 can then be pivoted relative to the staple magazine 16 to a position as shown in FIG. 1 with an urging flange 122 thereof abutting on one of the staples 30 (or 32).

A user can then thrust downward the handle portion 14 such that the striking bracket 12 together with the staple magazine 16 can be violently struck on a workpiece (not shown) such as a sheet of paper, a piece of leather and the like, with the staples 30 (or 32) being urged by means of the urging flange 122 to be emitted from a slot (not shown) defined in an underside of the staple magazine 16 into the workpiece and deeply into an object such as a floor, a board, a ceiling and the like, thereby securely binding the workpiece on the object.

Figure 4:
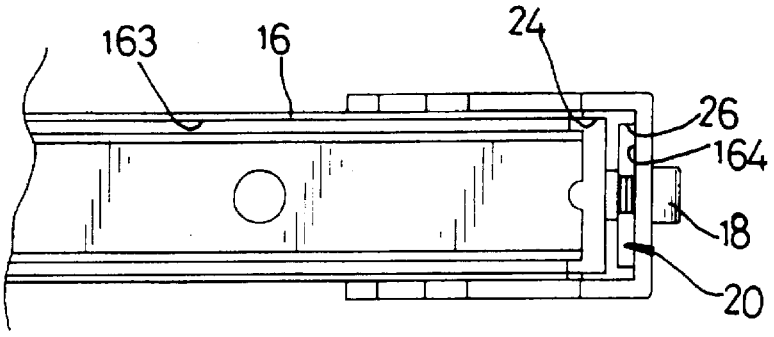
FIGS. 4 is a top plan view of FIG. 3.

Referring to FIGS. 4–6 with reference to FIG. 3, the staple positioning member 20 can be received in the chamber 164 with the first receiving space 24 facing the guiding channel 163 so as to securely position a plurality of first staples 30 of a larger size as shown in FIG. 5.

Alternatively, the staple positioning member 20 can also be received in the chamber 164 with the second receiving space 26 facing the guiding channel 163 so as to securely position a plurality of second staples 32 of a smaller size as shown in FIG. 6.

By such an arrangement, the staple positioning member 20 can be used to securely position staples of different sizes such that the binding device 10 can be adapted to operate staples of different sizes stably.

It should be clear to those skilled in the art that further embodiments of the present invention may be made without departing from the scope and spirit of the present invention.

What is claimed is:

1. A strike-type binding device (10) comprising:

a striking bracket (12) having a first end portion and a second end portion;

a handle portion (14) fixedly mounted on the first end portion of said striking bracket (12);

a staple magazine (16) having a guiding channel (163) longitudinally defined therein for receiving staples (30; 32) and including a first end portion (160) pivotally engaged with the first end portion of said striking bracket (12) and a second end portion (161) having a chamber (164) defined therein and communicating with said guiding channel (163); and a staple positioning member (20) mounted in said chamber (164) and including a first side having a first receiving space (24) defined therein and a second side having a second receiving space (26) defined therein, said first and second receiving spaces (24, 26) having a dimension different from each other for receiving staples (30; 32) of different sizes therein.

2. The binding device in accordance with claim 1, wherein said staple positioning member (20) has a hole (28) defined by a threaded wall thereof, a bore (162) defined in a side wall of the second end portion (161) of said staple magazine (16) and aligning with said hole (28), and a positioning bolt (18) extending through said bore (162) and threadedly received in said hole (18).

3. The binding device in accordance with claim 1, wherein said staple positioning member (20) has an H-shaped cross-section.

* * * * *